US007237550B1

(12) United States Patent
Lin

(10) Patent No.: US 7,237,550 B1
(45) Date of Patent: Jul. 3, 2007

(54) RESPIRATOR CONTAINING FILTER CASES

(76) Inventor: Jing-Jyr Lin, 4F., No.125, Zhiguang St., Yonghe City, Taipei County 234 (TW)

( * ) Notice: Subject to any disclaimer, the term of this patent is extended or adjusted under 35 U.S.C. 154(b) by 0 days.

(21) Appl. No.: 11/335,073

(22) Filed: Jan. 18, 2006

(51) Int. Cl.
*A62B 7/10* (2006.01)
*A62B 18/08* (2006.01)

(52) U.S. Cl. ..... 128/206.12; 128/205.27; 128/205.29; 128/206.17; 128/206.19; 128/206.21

(58) Field of Classification Search ..... 128/205.27, 128/205.29, 206.12, 206.13, 206.16, 206.17, 128/206.18, 206.19, 206.21, 206.27, 206.28
See application file for complete search history.

(56) References Cited

U.S. PATENT DOCUMENTS

| | | | | | |
|---|---|---|---|---|---|
| 2,139,137 | A * | 12/1938 | Schwartz | ..... | 128/206.17 |
| 2,578,007 | A * | 12/1951 | Hill | ..... | 128/206.17 |
| 2,744,523 | A * | 5/1956 | Malcom, Jr. et al. | ... | 128/206.17 |
| 3,142,549 | A * | 7/1964 | Klusewitz et al. | ..... | 96/121 |
| 4,141,703 | A * | 2/1979 | Mulchi | ..... | 93/132 |
| 4,573,464 | A * | 3/1986 | Yo | ..... | 128/206.15 |
| 4,754,751 | A * | 7/1988 | Mausteller et al. | .... | 128/201.25 |
| 4,945,907 | A * | 8/1990 | Tayebi | ..... | 128/206.12 |
| 5,140,980 | A * | 8/1992 | Haughey et al. | ..... | 128/201.25 |
| 5,797,974 | A * | 8/1998 | Flaherty et al. | ..... | 55/482 |
| 6,408,845 | B1 * | 6/2002 | Pereira et al. | ..... | 128/202.22 |
| 6,742,518 | B2 * | 6/2004 | Chang | ..... | 128/205.29 |
| 6,817,362 | B2 * | 11/2004 | Gelinas et al. | ..... | 128/206.17 |
| 2003/0029454 | A1 * | 2/2003 | Gelinas et al. | ..... | 128/205.27 |

* cited by examiner

*Primary Examiner*—Justine R. Yu
*Assistant Examiner*—Amadeus Lopez
(74) *Attorney, Agent, or Firm*—Pro-Techtor Int'l Services

(57) ABSTRACT

A respirator containing filter cases uses cellular elements or positioning boards provided in filter cases to consistently secure a plurality of particle-shape refillable filter materials in place, to prevent air breathing in through the respirator from forming channels between the particle-shape refillable filter materials in the filter cases, so that the particle-shape refillable filter materials in the filter cases can properly filter the incoming air, and the service life of the respirator can be extended; and, using a recessed space formed inside the respirator body, where an appropriate space can be reserved between the casing and the user's nose and mouth to enlarge the breathing area of filtered air passing through the filter cases, reduce pressure drop, and enable less breathing effort to the user even after extended period of time in wearing the present invention of respirator containing filter cases.

9 Claims, 6 Drawing Sheets

RESPIRATOR CONTAINING FILTER CASES

BACKGROUND OF THE INVENTION

In a conventional respirator containing active carbon filtering elements, as the molded respirator containing sorbent particles disclosed in U.S. Pat. No. 6,234,171 B1, the sorbent particles 11 (active carbon is used in most cases) are attached to the fabric 1. Due to the limited quantity of sorbent particles 11 attached to the unit area of the fabric 1, the unit area can be easily saturated and lose its efficiency, resulting in failure to satisfy the user's need to wear the respirator 2 for an extended period of time. Therefore, some manufacturers have provided such consumers (users) with a respirator 2 containing a filter can 20, such as models shown in FIGS. 2 and 3, using a plurality of filtering materials 21 contained in the filter can 20 of the respirator 2, in the hope of effectively filtering off organic toxic gases, inhibiting the regeneration of germs, eliminating bad odors, and extending the service life of effective filtering performance.

Such conventional models of respirator 2 containing a filter can 20, however, has a breathing area limited to the size of the outflow diameter 201 of the filter can 20, resulting in an air flow constriction as illustrated in FIG. 3. As a result, in extended use, the user often feels difficulty in breathing effort. Furthermore, due to gravitational force, the filtering particles 21 contained inside the filter can 20 would naturally develop a condition of differential pressure, with upper layer of filtering particles 211 compressing on lower layers of filtering particles 212,213. As a result, air filtered in and passing the filter can could easily form channels 22 through the upper layer of filtering particles 211 where the pressure is minimal, air permeability is maximal and condensation is lowest. In other words, air filtered inside and passing the filter can 20 will most likely flow only through the channels 22 formed in the upper layer of filtering particles 211 where the pressure is minimal, air permeability is maximal and condensation is lowest. Except the upper layer of filtering particles 211 in the filter can 20, it is obvious that most part of the lower layers of filtering particles 212,213 could not perform their air-filtering functions. The final result is, the effective filtering cubic capacity of the filter can 20 is minimized, and the service life of the respirator 2 is shortened.

SUMMARY OF THE INVENTION

In view of the above noted shortcomings, the present invention has provided a type of respirator containing filter cases, comprising a respirator body and at least one filter case; wherein the respirator body is made of at least one piece of airtight materials. The respirator body has at least one opening. The inside of the respirator body is a formation of a recessed space. An opening of the respirator body is fitted to a filter case; wherein, breathing air panel and a air inlet panel of the filter case respectively have a plurality of air holes. The filter case has a substantially rectangular box-shape, with the air inflow and air outflow on opposing major surfaces, allowing substantially equal area for the inlet air and the outflow air, thereby preventing an air flow constriction. The filter case has a cellular element or two or more positioning boards to consistently secure the refillable filtering particles in position, to prevent air breathing in through the respirator from forming channels in the refillable filtering particles in the filter cases, thereby the refillable filtering particles in the filter cases can properly filter incoming air and extend the service life of the respirator; and, using a recessed space formed inside the respirator body, an appropriate space can be maintained between the inside of the respirator body and the user's mouth and nose, so as to enlarge the breathing area of filtered air passing through the filter cases, reduce pressure drop, and enable less breathing effort to the user even after wearing the present invention of respirator containing filter cases for an extended period of time.

The primary objective of this invention is to provide a respirator containing filter cases, to prevent formation of channels in the filtering particles inside the filter cases by air breathing in through the respirator.

The secondary objective of this invention is to provide a respirator containing filter cases, to consistently secure a plurality of refillable filtering particles in proper place inside the filter cases.

Another objective of this invention is to provide a respirator containing filter cases, using cellular elements or positioning boards inside the filter cases in the respirator to consistently secure a plurality of refillable filtering particles in position.

A further objective of this invention is to provide a respirator containing filter cases, using a recessed space formed inside the respirator body of the respirator to reserve an appropriate space between the inside of the respirator body and the user's mouth and nose, to enlarge the breathing area of filtered air passing through the filter cases, reduce pressure drop, and enable less breathing effort to the user even after wearing the respirator for an extended period of time.

DETAILED DESCRIPTION OF THE DRAWINGS PREFERRED

First Preferred Embodiment

Figure 1:
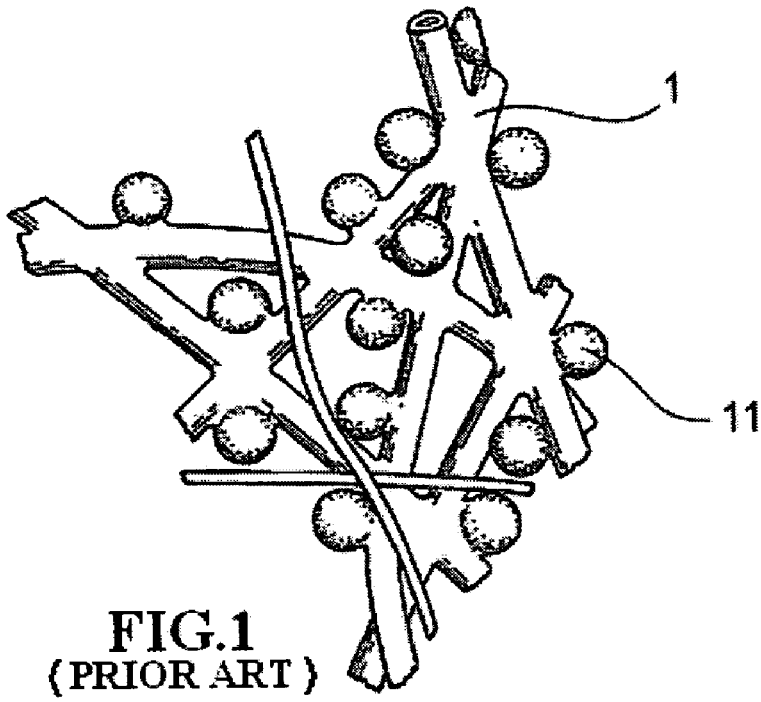
FIG.1 (PRIOR ART)
FIG. 1 shows the sorbent particles 11 (active carbon is used in most cases) attaching to a fabric 1 as disclosed in U.S. Pat. No. 6,234,171 B1 "MOLDED RESPIRATOR CONTAINING SORBENT PARTICLES".
Figure 2:
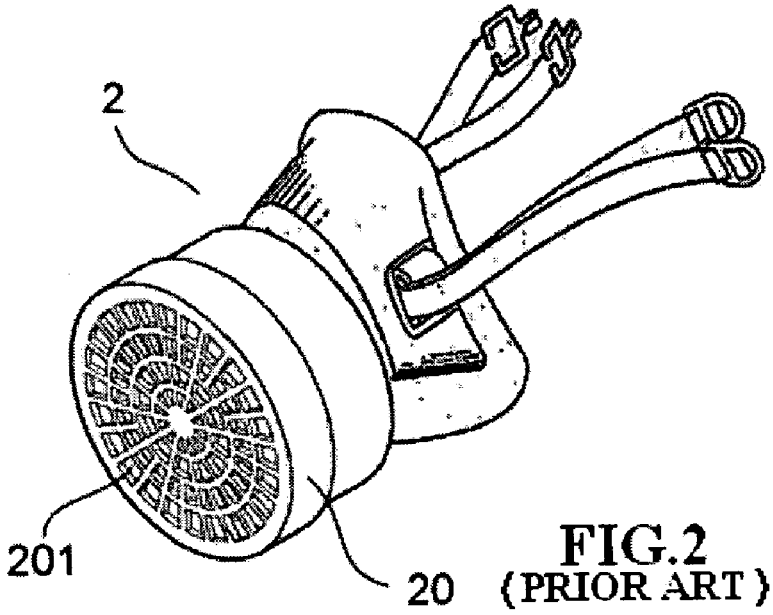
FIG.2 (PRIOR ART)
FIG. 2 is a perspective view of a prior art of respirator equipped with a filter can.
Figure 3:
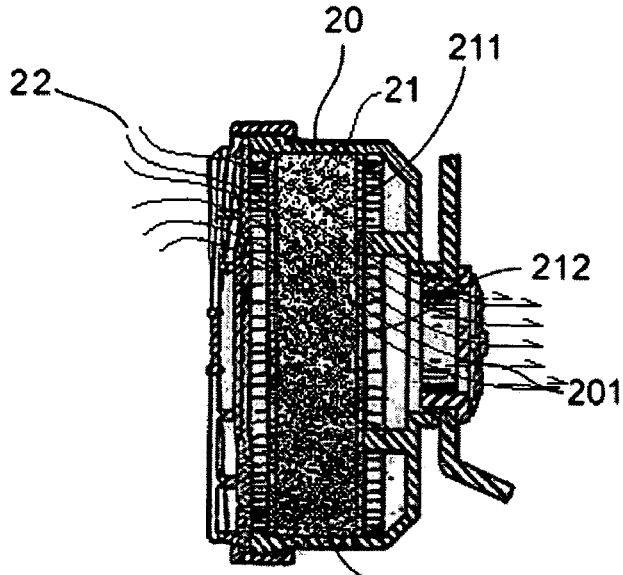
FIG.3 (PRIOR ART)
FIG. 3 is a sectional view of the prior art of respirator equipped with a filter can.
Figure 4:
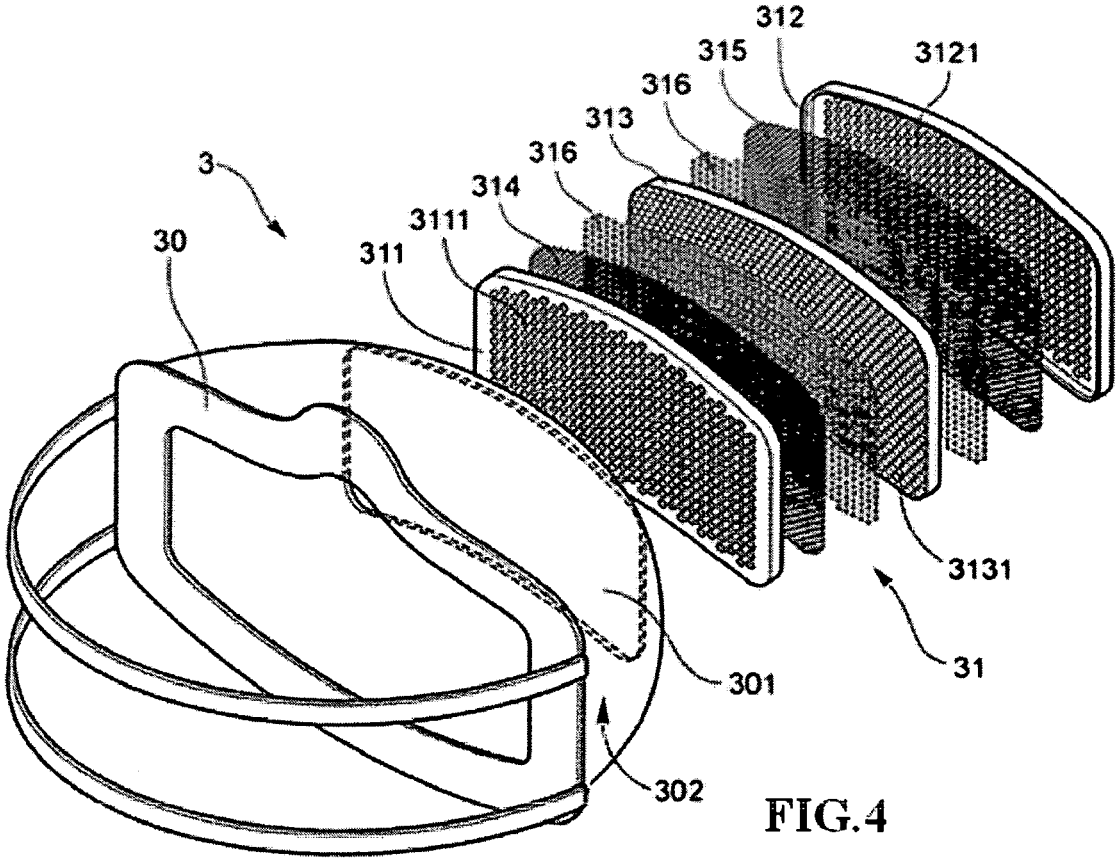
FIG. 4 is an exploded view of a first preferred embodiment of the present invention of respirator containing a filter case.
Figure 5:
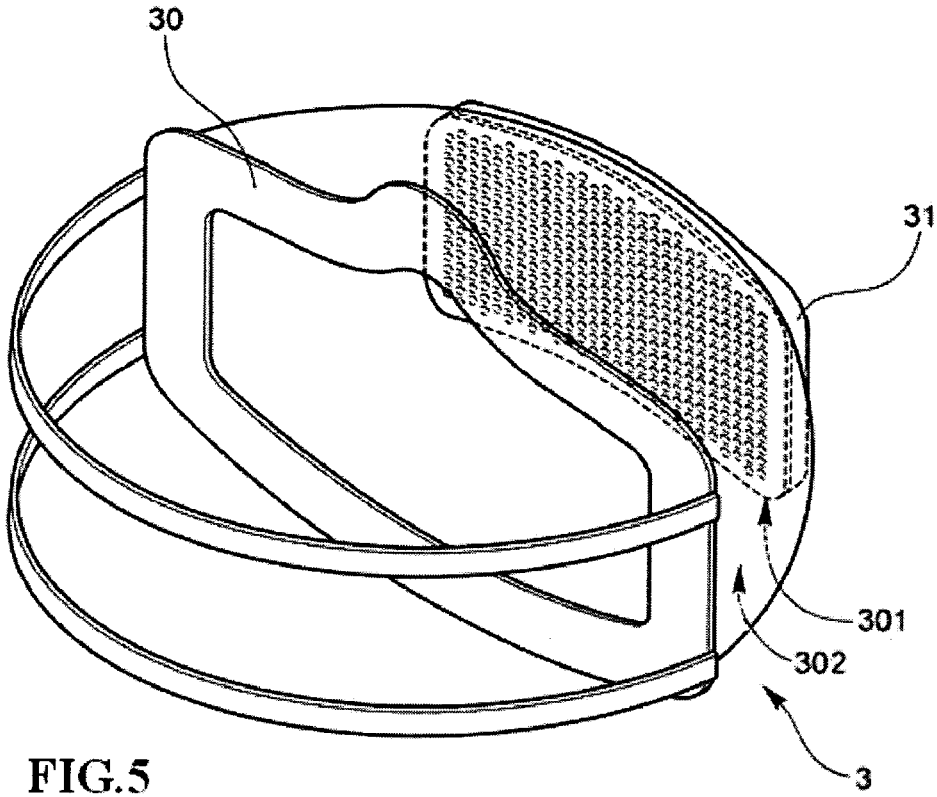
FIG. 5 is an assembled view of the first preferred embodiment of the present invention of respirator containing a filter case.
Figure 6:
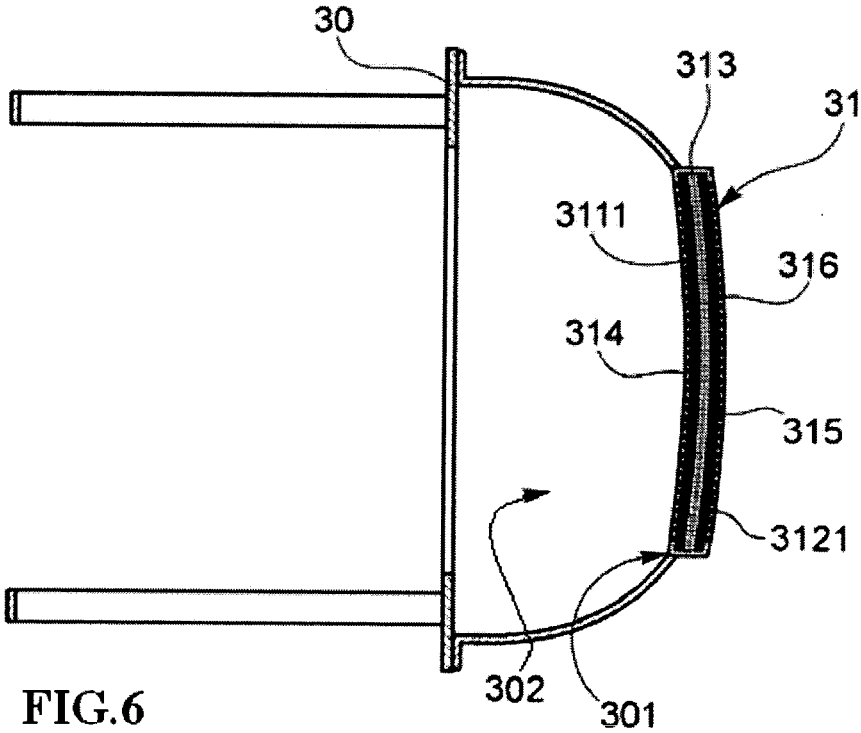
FIG. 6 is a sectional view of the first preferred embodiment of the present invention of respirator containing a filter case.

As shown in FIGS. 4 through 6, the first preferred embodiment of the present invention relates to a respirator containing a filter case 3, comprising a respirator body 30 and a filter case 31; wherein the respirator body 30 is made of a piece of airtight material, the respirator body 30 having an opening 301, inside the respirator body 30 being a formation of a recessed space 302; wherein the filter case 31 is joined to an opening 301 of the respirator body 30, the filter case 31 comprising breathing air panel 311 connected to a air inlet panel 312 by a peripheral side wall, forming a substantially rectangular box-shape, and containing a multi-layer filter element having a cellular element 313, two pieces of filter nets 314,315, and a plurality of nanometer-metal 316 as the active filter layer. The breathing air panel 311 of the filter case 31 has a plurality of air holes 3111. As a consequence of the substantially rectangular box-shape filter case 31, the breathing air panel 311 is allowed an area substantially equal to that of the inlet air panel 312, thereby preventing an air flow constriction. The air inlet panel 312 of the filter case 31 also has a plurality of air holes 3121. The nanometer-metal 316 of the filter case 31 are evenly filled inside a plurality of element holes 3131 on the cellular element 313. The filter case 31 positions the nanometer-metal 316 consistently in place in the element holes 3131 of the cellular element 313. The nanometer-metal 316 in each element hole 3131 will not create drastic pressure drop discrepancy due to gravitational force, so that air breathed into the respirator 3 containing the filter case is able to flow consistently through the nanometer-metal 316 inside the element holes 3131 of the cellular element 313, so they will not form channels therein. The nanometer-metal 316 consistently filled inside the element holes 3131 of the cellular element 313 will be able to properly filter the air sucked in, and increase the service life of the respirator 3 containing the filter case. In the first preferred embodiment of the present invention, the recessed space 302 formed on the inside of the respirator body of respirator 3 containing a filter case maintains an appropriate space between the inside of the respirator body 30 and the user's nose and mouth, thereby enlarging the breathing area of filtered air passing through the filter case 31, reducing the pressure drop, enabling less breathing effort for the user even after wearing the first preferred embodiment of the present invention of respirator 3 containing a filter case for an extended period of time.

Second Preferred Embodiment

Figure 7:
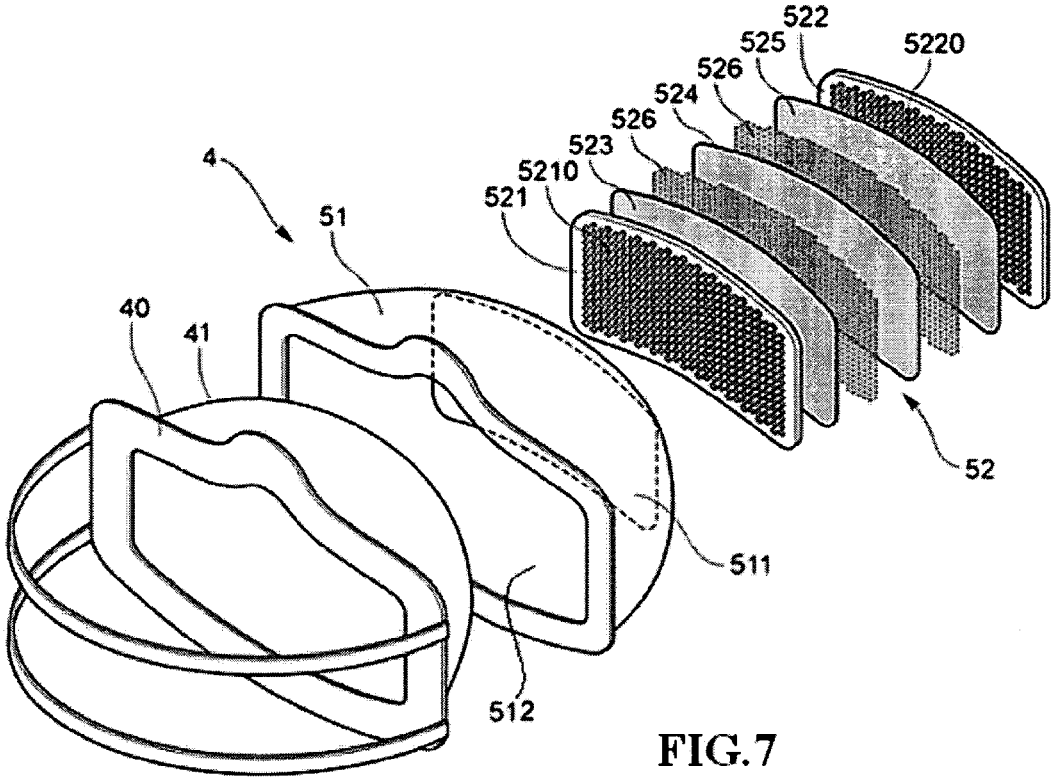
FIG. 7 is an exploded view of a second preferred embodiment of the present invention of respirator containing a filter case.
Figure 8:
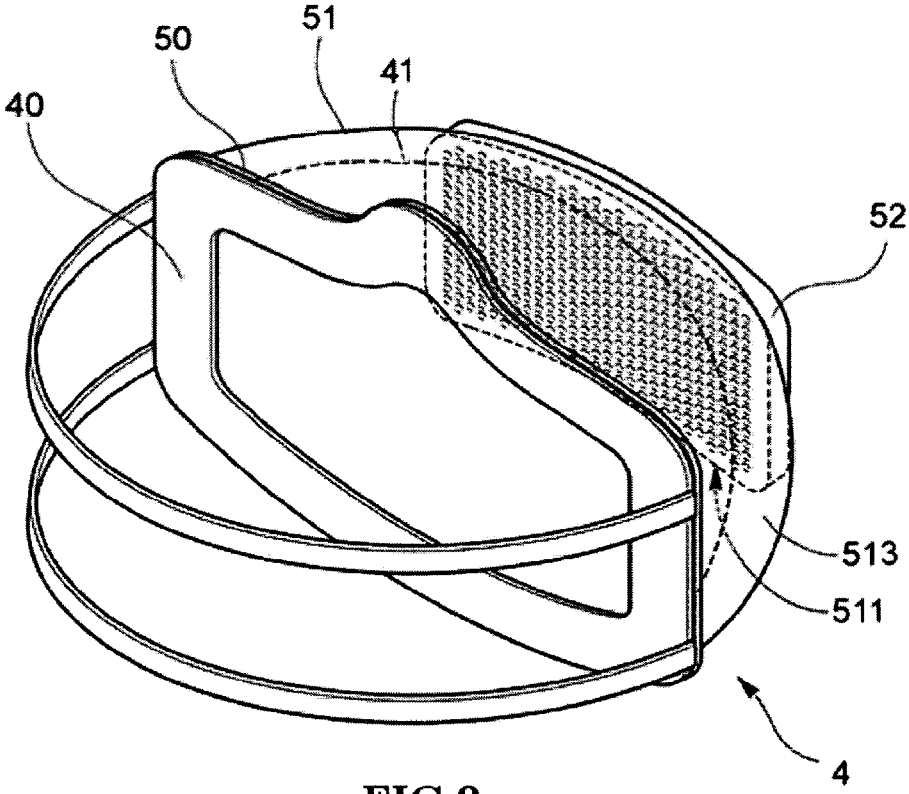
FIG. 8 is an assembled view of the second preferred embodiment of the present invention of respirator containing a filter case.
Figure 9:
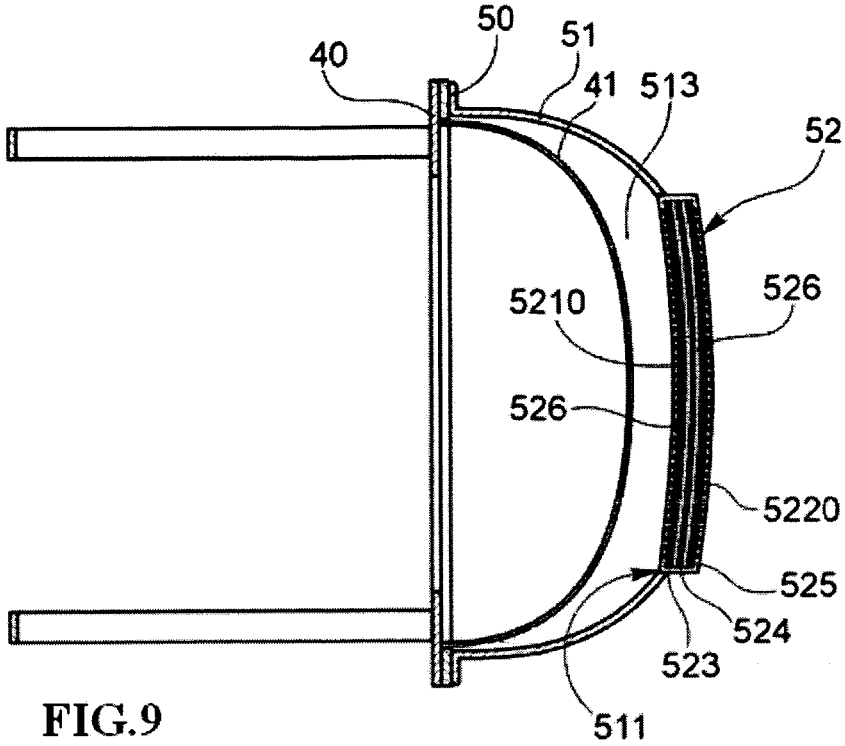
FIG. 9 is a sectional view of the second preferred embodiment of the present invention of respirator containing a filter case.

The respirator body 30 has an opening 301. Inside the respirator body is a formation of a recessed space 302. As shown in FIGS. 7 through 9, the second preferred embodiment of the present invention relates to a respirator 4 containing a filter case, comprising a inner filter cup 40 in combination with a respirator body 51; wherein the inner filter cup 40 is made of a piece of air permeable material, on the outside of the inner filter cup 40 is a protruded surface 41; wherein the inner filter cup 40 is interior of the respirator body 51 and a filter case 52. The respirator body 51 is made of a piece of airtight material. The respirator body 51 has an opening 511. On the inside of the respirator body 51 is a formation of a recessed space 512. The recessed space 512 inside the respirator body 51 is larger than the protruded surface 41 outside the three inner filter cup 40. The inside margin of the respirator body 51 is designed to join squarely with the outside margin of the inner filter cup 40. After the inside margin of the respirator body 51 is joined with the outside margin of the inner filter cup 40, because the recessed space 512 inside the respirator body 51 is larger than the protruded surface 41 outside the inner filter cup 40, a recessed space 513 is formed between the inside of the respirator body 51 and the protruded surface 41 of the inner filter cup 40, the recessed space 513 being slightly smaller than the recessed space 512 formed inside the respirator body 51. The filter case 52, having a substantially rectangular box-shape, is joined to the inside margin of the opening 511 of the respirator body 51. The breathing air panel 521 of the filter case 52 has a plurality of air holes 5210. The air inlet panel 522 of the filter case 52 also has a plurality of air holes 5220. The filter case 52 contains a multi-layer filter element which has three positioning boards 523,524,525 and a plurality of active carbon 526 as the active filter layer. The positioning boards 523,524,525 in the filter case 52 are made of air permeable fabrics. The positioning boards 523,524,525 in the filter case 52 enclose and press the active carbon 526 in place, so the upper-level active carbon 526 will not compress on the lower-level active carbon 526, and the condensation of upper-level and lower-level active carbon 526 is maintained at a consistent level and there will be no difference of pressure drop between them, thereby preventing the formation of channels between the upper-layer active carbon 526 in the filter case 52 by air breathing into the respirator, enabling consistent filtering and breathing of air through the active carbon 526 in the filter case 52, and extending the service life of the respirator 4 containing a filter case as described in the second preferred embodiment of the present invention. In the second preferred embodiment of the present invention of respirator 4 containing a filter case, the recessed space 513 formed between the inside of respirator body 51 and the protruded surface 41 of the inner filter cup 40 serves to enlarge the breathing area of filtered air passing through the filter case 52, reduce pressure drop, and enable less breathing effort for the user even after wearing the second preferred embodiment of the present invention of respirator 4 containing a filter case for an extended period of time.

Third Preferred Embodiment

Figure 10:
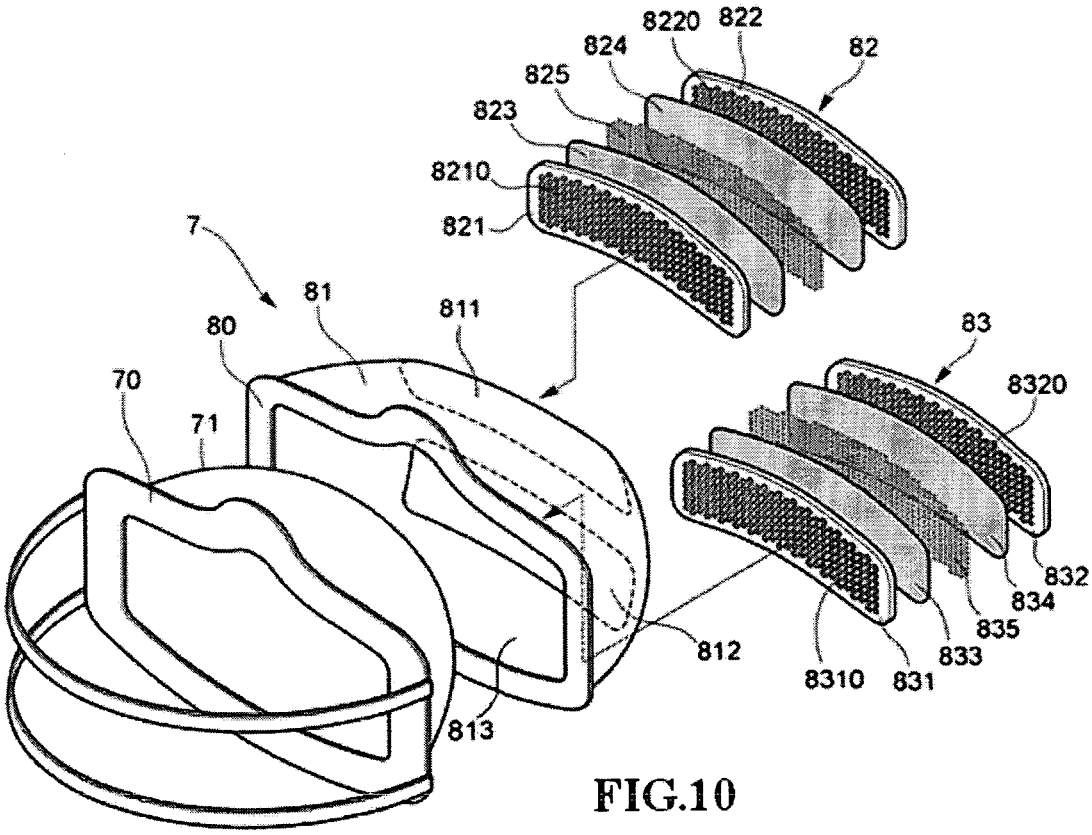
FIG. 10 is an exploded view of a third preferred embodiment of the present invention of respirator containing a filter case.
Figure 11:
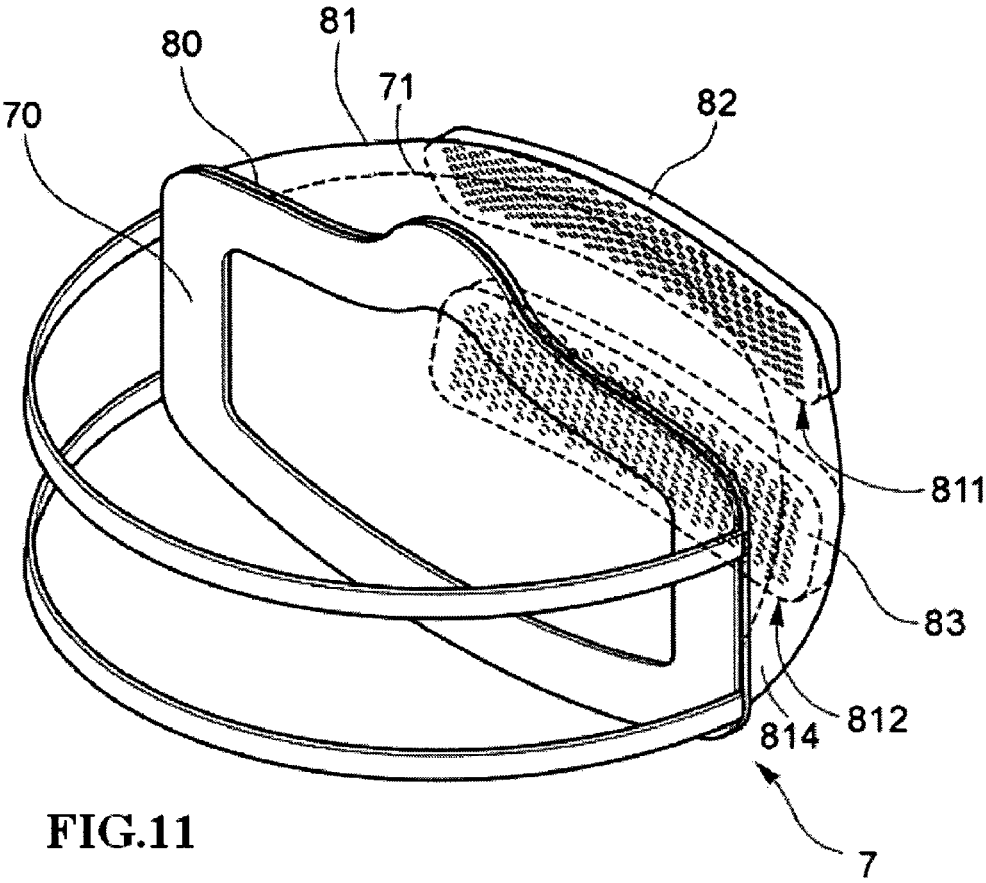
FIG. 11 is an assembled view of the third preferred embodiment of the present invention of respirator containing a filter case.
Figure 12:
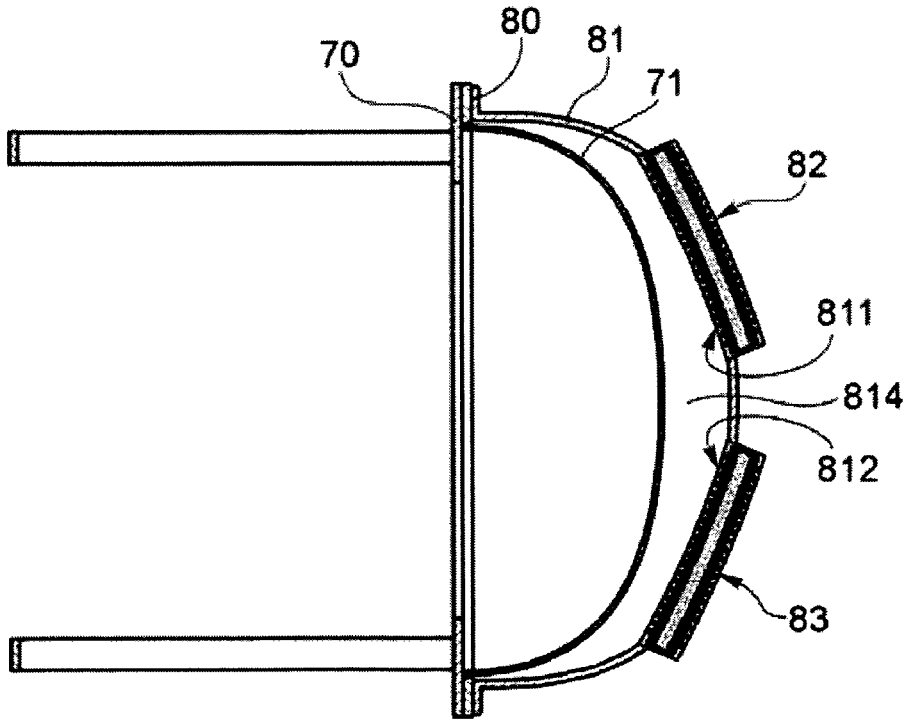
FIG. 12 is a sectional view of the third preferred embodiment of the present invention of respirator containing a filter case.

As shown in FIGS. 10 through 12, the third preferred embodiment of the present invention of respirator 7 containing a filter case comprises a inner filter cup 70 in combination with a respirator body 81. The inner filter cup 70 is made of air permeable materials, the outside of the inner filter cup being a formation with a protruded surface 71. Wherein, the respirator 7 comprises a respirator body 81 and two filter cases 82,83. The respirator body 81 is made of two pieces of airtight materials. The respirator body 81 has an upper and a lower opening 811,812. The openings 811, 812 on the respirator body 81 are of a same shape. Inside the respirator body 81 is a formation of a recessed space 813. The recessed space 813 in the respirator body 81 is larger than the protruded surface 71 formed outside the inner filter cup 70. The inside surface of the respirator body 81 fits squarely with the outside surface of the inner filter cup 70. When the inside surface of the respirator body 81 and the outside surface of the inner filter cup 70 are fitted together, because the recessed space 813 formed inside the respirator body 81 is larger than the protruded surface 71 formed outside the inner filter cup 70, there is a recessed space 814 formed between the inside of the respirator body 81 and the protruded surface 71 of the inner filter cup 70. The recessed space 814 is slightly smaller than the recessed space 813 formed on the inside of the respirator body 81. Wherein, the construction and substantially rectangular box-shape of the two filter cases 82,83 are the same. The filter case 82 is joined to the inside of the upper opening 811 on the respirator body 81. The filter case 83 is joined to the inside of the lower opening 812 of the respirator body 81. The breathing air panel 821 of the filter case 82 has a plurality of air holes 8210. The air inlet panel 822 of the filter case 82 also has a plurality of air holes 8220. A multi-layer filter element inside the filter case 98 has two positioning boards 823,824 and a plurality of active carbon 825 as the active filter layer. The breathing air panel 831 of the filter case 83 has a plurality of air holes 8310. The air inlet panel 832 of the filter case 83 also has a plurality of air holes 8320. The multi-layer filter element inside the filter case 83 contains two positioning boards 833,834 and a plurality of active carbon 835 as the active filter layer; wherein, the positioning boards 823,824 inside the filter case 82 enclose and press the active carbon 825 in position, the positioning boards 823, 824 in the filter case 82 being made of air permeable foam rubber. The positioning boards 833,834 inside the filter case 83 enclose and press a plurality of particle-shape active carbon 835 in position, the positioning boards 833,834 in the filter case 83 being made of air permeable foam rubber. As shown in FIG. 11, the third preferred embodiment of the present invention of respirator 7 uses the positioning boards 823,824 in the filter case 82 to enclose and press the active carbon 825 in position, and uses the positioning boards 833,834 in the filter case 83 to enclose and press the active carbon 835 in position, to prevent air breathing into the respirator 7 from forming channels between the active carbon 825 in the filter case 82, or between the active carbon 835 in the filter case 83, thereby, the active carbon 825 in the filter case 82 and the active carbon 835 in the filter case 83 are capable of properly filtering incoming air, and extending the service life of the third preferred embodiment of the present invention of respirator 7 containing a filter case. The recessed space 814 formed between the inside of the respirator body 81 and the protruded surface 71 of the inner filter cup 70 serves to enlarge the breathing area of filtered air passing through the filter cases 82,83, reduce pressure drop and enable less breathing effort for the user even after wearing the third preferred embodiment of the present invention of respirator 7 containing a filter case for an extended period of time.

It is to be understood that the above description covering some preferred embodiments of the present invention should not be based to restrict the present invention, and that various alterations, modifications and applications made without departing from the spirit of the present invention shall be included in the subject claim, including but not limited to the installation of various different geometrical configurations of cells similar to the cellular element in the filter case (serving to fix a plurality of particle-shape refillable filter materials), the installation of various positioning boards made of similar fabrics or foam rubber materials in the filter case, the installation of various different geometrical configurations of positioning boards that are air permeable and capable of holding a plurality of particle-shape refillable filtering materials in position, and the attachment of inner filter cup with a protruded surface of various shapes inside the respirator body, forming a space in various shapes between the inside of the respirator body and the protruded surface of the inner filter cup.

What is claimed is:

1. A respirator containing a filter case, comprising at least one filter case of a substantially rectangular box-shape, having an inlet air panel, with a plurality of air holes, on a first major surface of said filter case, a breathing air panel, with a plurality of air holes, on a second major surface of said filter case, being substantially equal in size, and located opposite, to said first air panel, and a peripheral side wall connecting said inlet air panel to said breathing air panel, and a multi-layer filter element pressed between said inlet air panel and said breathing air panel, having an air-permeable positioning board adjacent to each of said air inlet panel and said breathing air panel with at least one refillable active filter layer sandwiched between said air-permeable positioning boards, thereby holding said refillable active filter layer in position; and a respirator body having an air-impermeable outer surface, a first opening adapted to fit over the mouth and nose of a user, at least one filter opening substantially opposite said first opening, each said filter opening being adapted to accommodate one said filter case, and a breathing space recess, between said first opening and said at least one filter opening, enclosed by said outer surface;

wherein said respirator body further comprises an inner filter cup, having an opening adapted to fit over the mouth and nose of a user, and a protruded surface of air permeable material extending into said breathing space recess.

2. The respirator containing a filter case of claim 1 wherein said refillable active filter layer comprises active carbon.

3. The respirator containing a filter case of claim 1, wherein said refillable active filter layer comprises nanometer metal.

4. The respirator containing a filter case of claim 1 wherein said positioning boards comprise filter nets.

5. The respirator containing a filter case of claim 1 wherein said positioning boards comprise a cellular element.

6. The respirator containing a filter case of claim 1, wherein said positioning boards comprise air permeable fabric.

7. The respirator containing a filter case of claim 1 wherein said positioning boards comprise air permeable foam.

8. The respirator containing a filter case of claim 1, wherein said refillable active filter layer has active carbon, and said positioning boards comprise air permeable foam.

9. The respirator containing a filter case of claim 1, wherein said filter element has multiple layers of active carbon, sandwiched between positioning boards of air permeable fabric.

* * * * *